US006941987B2

(12) United States Patent
Robinson

(10) Patent No.: US 6,941,987 B2
(45) Date of Patent: Sep. 13, 2005

(54) APPARATUS FOR CLEARING LOG JAMS IN DISC TYPE CHIPPER

(75) Inventor: Mark D. Robinson, Black River, NY (US)

(73) Assignee: CEM Machine, Inc., Carthage, NY (US)

( * ) Notice: Subject to any disclaimer, the term of this patent is extended or adjusted under 35 U.S.C. 154(b) by 80 days.

(21) Appl. No.: 10/457,496

(22) Filed: Jun. 9, 2003

(65) Prior Publication Data

US 2004/0244870 A1 Dec. 9, 2004

(51) Int. Cl.[7] ..... B27C 1/12; B02C 11/04

(52) U.S. Cl. ..... 144/176; 144/180; 241/34; 209/245

(58) Field of Search ..... 144/369, 370, 144/373, 172–176, 162.1, 180; 241/92, 93, 296, 34; 209/243–245

(56) References Cited

U.S. PATENT DOCUMENTS

| | | | | |
|---|---|---|---|---|
| 2,582,537 A | | 1/1952 | Flateboe | |
| 2,837,290 A | | 6/1958 | Nagel | |
| 4,134,554 A | | 1/1979 | Morlock | |
| 4,140,282 A | | 2/1979 | Steimel | |
| 4,449,671 A | | 5/1984 | Martinez-Vera et al. | |
| 4,690,337 A | | 9/1987 | Stiefel | |
| 5,248,100 A | | 9/1993 | Arakawa | |
| 5,293,917 A | * | 3/1994 | Kalliokoski | 144/373 |
| 5,477,900 A | | 12/1995 | Gray | |
| 5,667,152 A | * | 9/1997 | Mooring | 241/37.5 |
| 6,164,350 A | | 12/2000 | Olofsson et al. | |

* cited by examiner

*Primary Examiner*—Derris H. Banks
*Assistant Examiner*—Shelley Self
(74) *Attorney, Agent, or Firm*—Wail Marjama & Bilinski LLP

(57) ABSTRACT

Apparatus for processing logs to manufacture wood chips. The apparatus includes a circular disc for passing a series of blades through a chipping station and a chute and spout assembly for feeding logs from a conveyor into the chipping station. A lifting mechanism is mounted for rotation upon a shaft which is situated adjacent to but outside of the chute and spout assembly. A drive unit is arranged to turn the shaft so that the lifting mechanism is rotated between a retracted position outside of the flow described by the chute and spout assembly and an extended position inside the chute and spout assembly whereby the lifting mechanism can contact logs within the assembly and move the logs contra to the direction of flow.

19 Claims, 4 Drawing Sheets

APPARATUS FOR CLEARING LOG JAMS IN DISC TYPE CHIPPER

FIELD OF THE INVENTION

This invention relates to a wood chipper and in particular to apparatus for reducing logs to pulpwood chips.

BACKGROUND OF THE INVENTION

Many products such as paper products are manufactured from wood chips which are cut from logs that are fed into the cutting station of a chipper. Most large chippers are electrically driven and contain a generally vertically disposed rotatable cutting disc having a series of radially disposed blades equally spaced about the disc. Logs are fed lengthwise in a random fashion into the chipping station of the machine by means of a chute and spout assembly where the blades rapidly reduce the logs to chips. As a result, many logs of varying sizes and shapes can be passing through the chute and spout assembly at a given time where it is not uncommon for the logs to become jammed thus terminating the flow of logs into the cutting station.

Because of the extremely high starting loads required by the electrical drive motor of this type of equipment, it is the common practice to clear any log jams without shutting down the machine. It was the early practice in the industry to attempt clearing a jam by manual means using grappling equipment and the like. This method was not only hazardous to the workers who were trying to clear the jam but also to the rotating chipper disc. Grappling equipment that might fall into the chipping station would invariably contact the blades mounted upon the disc and destroy the blades and damage the disc.

Split spouts were later developed as a means of more safely clearing jams in the spout area. The spout in this case includes an enclosed generally cylindrical assembly that is split axially into two approximately half sections. One section is stationarily mounted upon the machine frame while the other section is movably attached to the first section by rocker arms that guide the movable section upwardly and rearwardly away from the cutting station to widen the spout area. The split spout arrangement clearly represents a safety improvement when compared to the more hazardous manual method then employed in the industry. However, the movable section of most split spouts can only separate a few inches from the fixed section of the spout and the device can not be relied upon to clear all log jams that occur in the spout area.

A U.S. Pat. No. 5,477,900 to Gray describes an improved chute and spout assembly that employs a series of hydraulic rams in an effort to clear log jams that might form in the assembly. The rams are spaced about the assembly so that the piston rod of each ram can move upwardly into the log flow stream from a retracted position in the hope that the log or logs causing a jam are dislodged to a point where the flow is reestablished. It has been found, however, that the linearly directed piston rod can oftentimes pass between the logs or produce only a small displacement of the jammed log which is insufficient to clear the jam.

SUMMARY OF THE INVENTION

It is an object of this invention to improve the design of chute and spout assemblies for delivery of logs to the chipping station of a disc type wood chipper.

It is a further object of the invention to rapidly and efficiently clear log jams that might occur in and about the chute and spout assembly of a disc type wood chipper.

A still further object of the present invention is to provide a log jam clearing apparatus that sweeps upwardly into the log flow stream in an arcuate motion to more efficiently clear any jams occurring in and about the chute and spout areas of a disc type wood chipper.

Another object of the present invention is to employ a plurality of different mechanisms to clear log jams in and around the log delivery system of a disc type chipper.

These and other objects are attained in the main embodiment of the invention by means of a disc type wood chipper having a circular disc containing a series of blades that is rotated through a chipping station. A chute and spout assembly is adapted to gravity feed logs from a conveyor into the chipping station along a given flow path where the logs are reduced to wood chips. A lifting mechanism is mounted for rotation about a shaft that is positioned outside of the chute and spout assembly. A drive unit rotates the shaft so as to move the lifting mechanism from a retracted position outside the flow path to an extended position wherein the lifting mechanism passes into the flow path so as to move logs in the flow path upstream with regard to the direction of flow thereby clearing any log jams located in the chute and spout assembly. In further embodiments of the invention other log clearing devices are stationed along the flow path that can act alone or in concert to clear jams in various flow path regions.

BRIEF DESCRIPTION OF THE DRAWINGS

For a further understanding of these and objects of the present invention, reference will be made to the following detailed description of the invention which is to be read in association with the associated drawings, wherein.

DETAILED DESCRIPTION OF THE INVENTION

Figure 1:
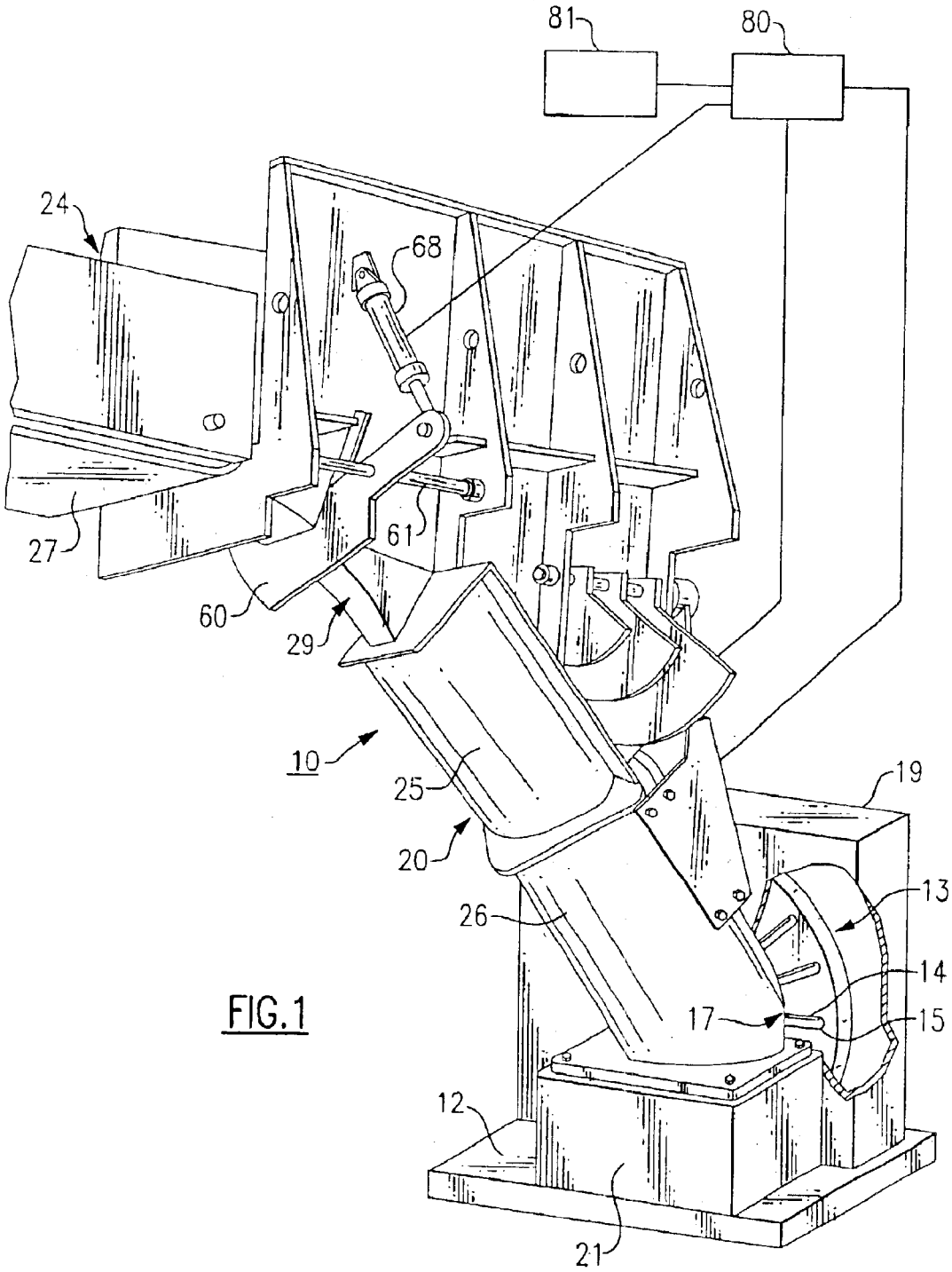
FIG. 1 is a perspective view of a wood chipping machine embodying the teachings of the present invention.

Turning initially to FIG. 1, there is illustrated a wood chipping machine, generally referenced 10, embodying the present invention. The machine includes a stationary base 12 upon which a chipping disc 13 is mounted upon a drive shaft for rotation in appropriate journal bearings so that the disc can be turned at a relatively high speed. A series of more or less radially extended blades 14 are mounted in suitable openings 15 that are formed in the disc with the blades being equally spaced about the circumference of the disc. The disc is driven by a high speed electrical motor (not shown) or any other suitable power source so as to pass the blades seriatim through a chipping station 17. The disc is enclosed within a housing 19.

A chute and spout assembly 20 is mounted upon a pedestal 21 at the entrance to the chipping station. The chute and spout assembly is arranged to gravity feed logs from a hopper 24 into the chipping station. The assembly includes an upper chute section 25 that is connected to a lower spout section 26 to form a flow path for the logs as they move toward the chipping station. A conveyor 27 is arranged to deposit logs riding upon the conveyor into the hopper where they are fed into the entrance of the chute and spout assembly through an entrance duct 29.

As noted above, the logs of varying diameters and length are randomly delivered by the conveyor into the entrance region of the chute and spout assembly. Accordingly, the logs can become jammed in the gravity flow path leading to the chipping station. The jams generally form in regions where the flow path narrows and becomes more restricted. These regions typically are at the entrance to the spout and at the exit of the chute and spout assembly, the region where the chute joins the spout and in the spout section itself. Clearing a jam without shutting down the machine or risking injury to the machine operators has been a long sought after goal within the industry. As will become evident from the disclosure below, the apparatus of the present is specifically designed to attain these goals.

Figure 2:
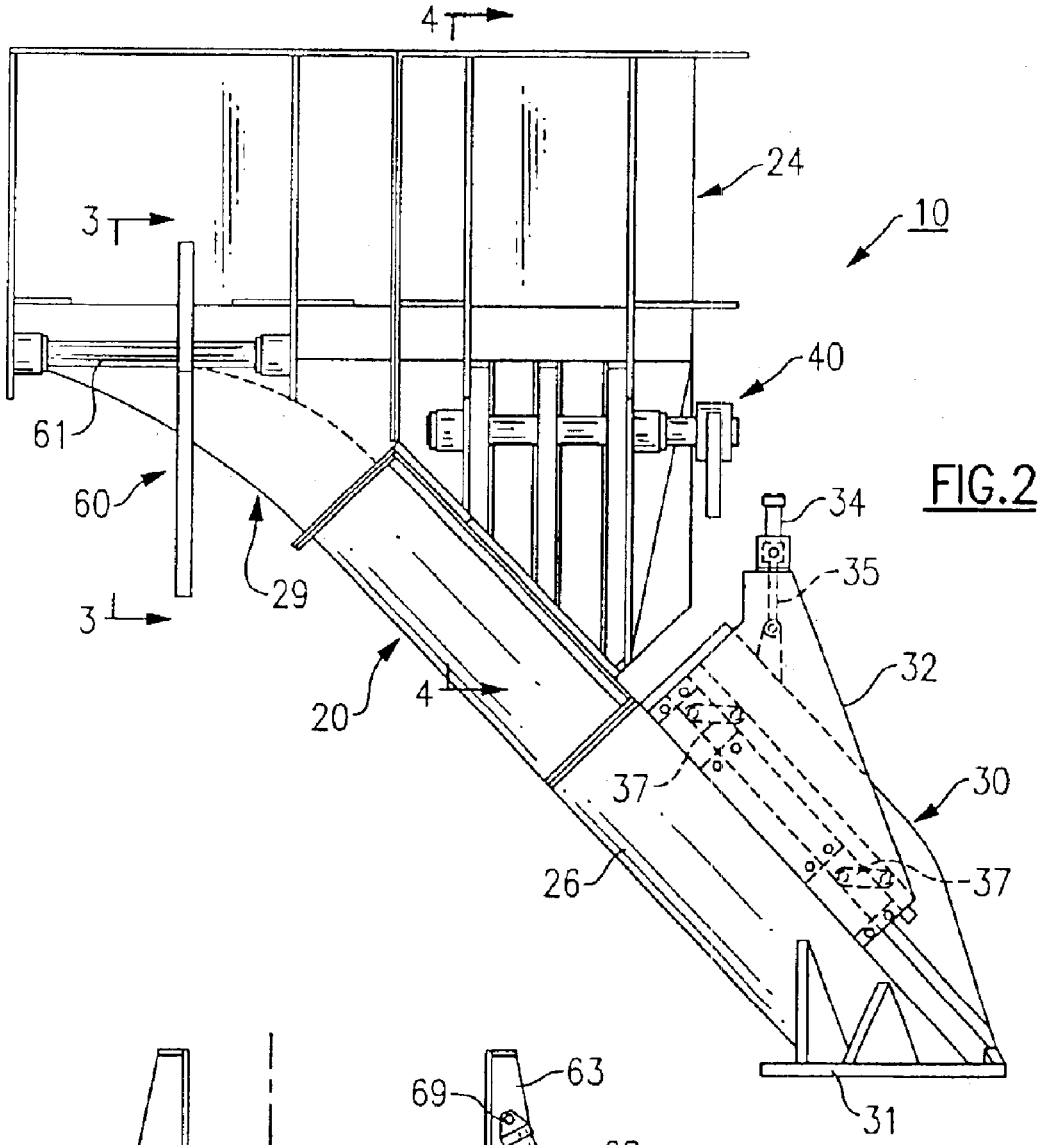
FIG. 2 is a side elevation of the wood chipping machine shown in FIG. 1 with the chipping disc and stationary base removed being removed for clarity.
Figure 3:
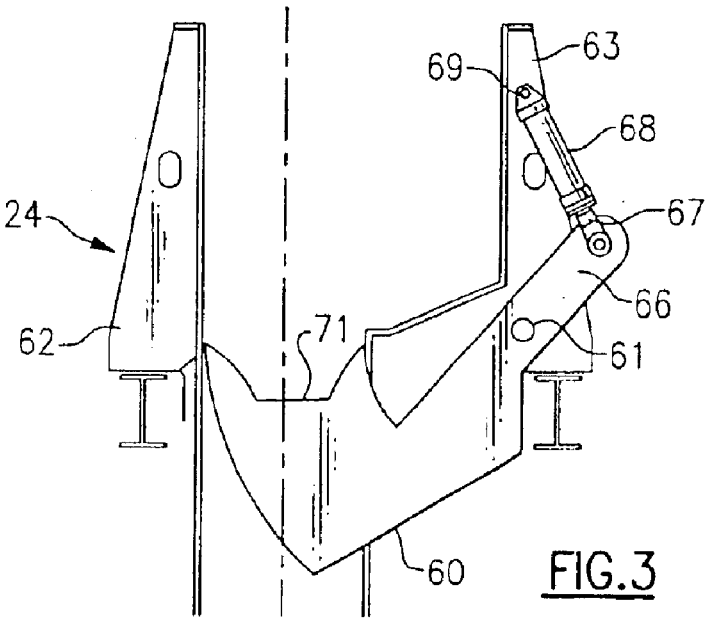
FIG. 3 is a partial view taken along lines 3—3 in FIG. 2 showing a lever arm unit that is mounted at the entrance duct to the chute and spout assembly of the machine.
Figure 4:
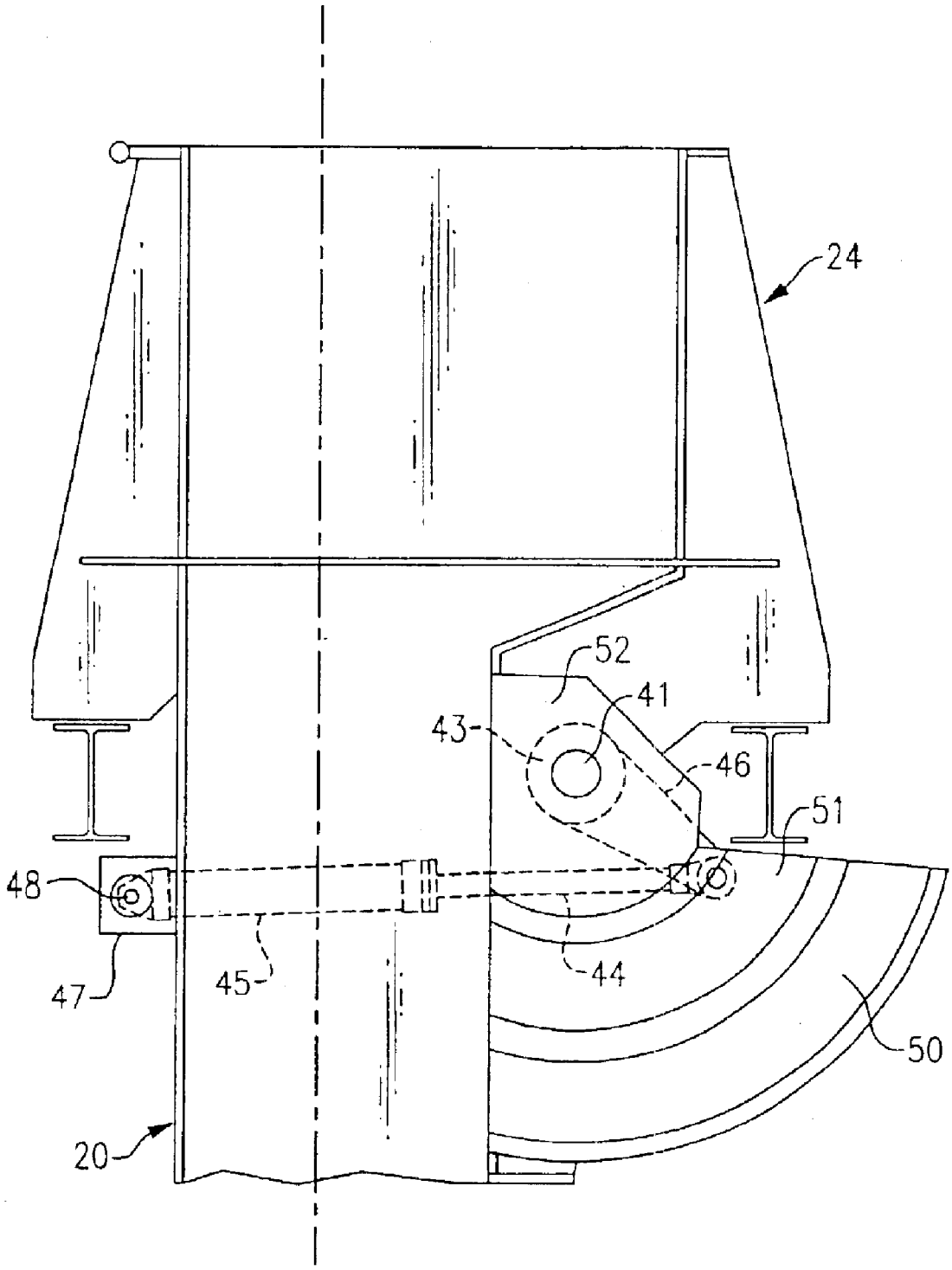
FIG. 4 is a partial view taken along lines 4—4 in FIG. 2 illustrating a lifting mechanism for clearing log jams in the chute and spout assembly.

With further reference to FIGS. 2–4 the spout section 26 of the chute and spout assembly is enclosed by a removable cover generally referenced 30 that forms the upper half of the spout section. The lower half of the spout is stationarily secured to the pedestal of the machine by a suitable mounting bracket 31. The cover extends axially along the length of the spout and is contained within a frame 32. A pneumatic or hydraulic jack 34 is mounted in the frame above the cover and the ram 35 of the jack is connected to the cover so that the cover can be lifted upwardly away from the spout section. The motion of the cover is controlled by a pair of links 37 aligned along each side of the cover. One end of each link is joined to the cover while the opposite end of the link is pinned in the lower spout section. Accordingly, when the cover is raised by the jack it separates radially from the spout section while at the same time moves axially in an upward direction contra to the direction of flow of the logs that are moving in the flow path through the spout.

This enclosed spout arrangement is generally referred to as a split spout and has been known and used in the art for some time. The amount of separation afforded between the cover and the spout section is generally limited to a few inches due to machine constraints thus correspondingly limiting the effectiveness of the split spout. The split spout, furthermore, has little or no effect upon log jams that might occur in other parts of the flow path leading from the hopper to the chipping station.

As best illustrated in FIG. 4, a log clearing mechanism generally referenced 40 is mounted in the chute and spout assembly in the region where the chute narrows down and enters the spout section. This mechanism is designed to sweep upwardly into this restricted area and engage any logs that might become jammed in this region and move the logs upwardly with regard to the direction of flow to effectively clear the jam. The mechanism includes a shaft 41, is journalled for rotation in suitable bearing blocks 43 adjacent to and outside of the chute and spout assembly. The shaft is connected to the distal end of the piston rod 44 of a double acting hydraulic cylinder 45 by means of a crank 46. One end of the pneumatic or hydraulic cylinder is pinned to a bracket 47 that is welded or otherwise affixed to a stationary member of the machine so that the cylinder can swing freely about the pin 48.

A plurality of arcuate shaped plates 50–52 are secured to the shaft for rotation therewith each plate contains a different radius from that of its neighbor with the larger radius plate being at one end of the shaft with the intermediate plate being centered between the two end plates. Each plate is slidably contained within a slot formed in the side wall of the chute and spout assembly whereby the plates can be rotated into and out of the log flow path of the assembly as the shaft is rotated between an open and closed position.

In this embodiment of the invention three plates 50–52 are utilized in the log clearing mechanism, however, the number of plates may vary without departing from the teachings of the invention. The mechanism is illustrated in a retracted position in FIG. 4 wherein the end faces of the plates are flush with the inside surface of the chute and spout assembly. Accordingly, the bars will not snag any logs that are moving through the flow path of the unit when the mechanism is in the retracted position. The plates are arranged to be rotated by the shaft and crank arrangement, to an extended position inside the chute and spout assembly. In operation the plates are rotated upward into the flow path to lift any jammed logs in this region flow and thus clear the jam.

As illustrated in FIGS. 2 and 3, a lever arm 60 is mounted in the floor of the entrance duct 29 to the chute and spout assembly. The lever arm is rotatably supported upon a shaft 61 that is suspended between stationary ribs 62 and 63 that form part of the conveyor hopper. The lever arm is slidably mounted in a slot formed in the floor of the entrance duct with the end face 71 of the lever arm complementing the shape of the floor as illustrated in FIG. 3. The distal end 66 of the lever arm is connected to the piston rod 67 of a double acting hydraulic cylinder 68. One end of the cylinder is pinned to a rib 63 so that the cylinder can swing freely about the pin 69.

The lever arm 60 is shown in a retracted position in FIG. 3 wherein the end face 71 of the lever arm is flush with the floor of the entrance duct. The arm is arranged to be turned about the shaft 61 by the pneumatic or hydraulic cylinder to raise the arm from the retracted position upwardly into an extended position inside the entrance region to displace any logs that may jam in this particular flow path region.

The two double acting cylinders 45 and 61 as well as the jack 34 that is employed to lift the cover of the split spout are connected by suitable control lines to a hydraulic pumping system or pneumatic power source 80 (FIG. 1) which routes fluid to the cylinders to extend and retract the log clearing mechanisms 40 and 60 and to the jack to open and close the split spout cover. The pumping system, in turn, is controlled by a processor 81 so that the log clearing mechanism and the jack can be actuated together at the same time or, alternatively, in selected pairs or individually as the need dictates.

Figure 5A:
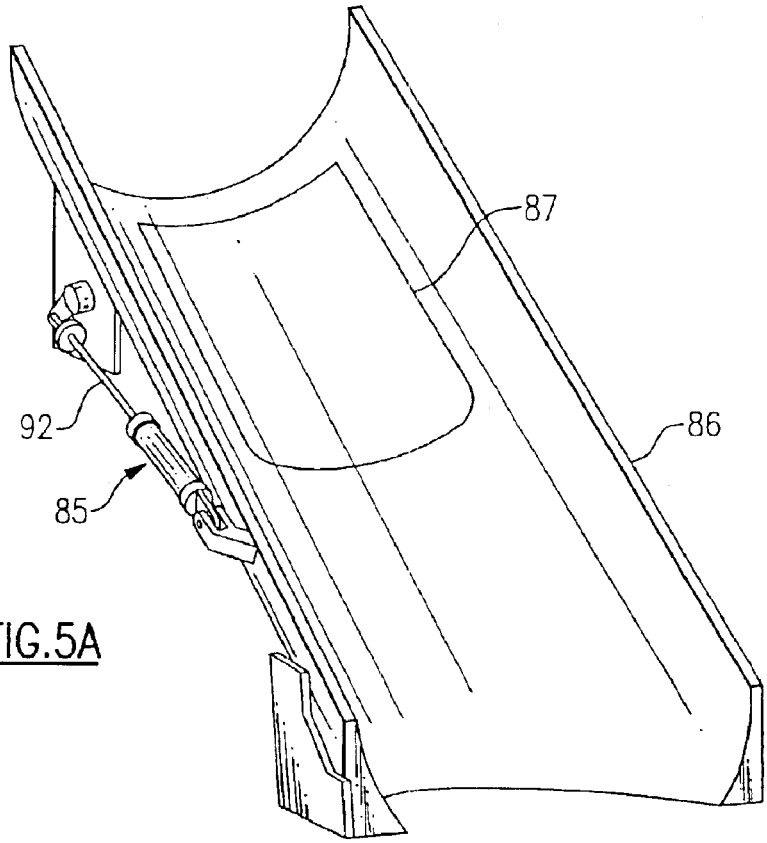
FIG. 5*a* is a partial view in perspective showing a further embodiment of the invention wherein the lifting mechanism is mounted in an open spout showing the mechanism in a retracted position.
Figure 5B:
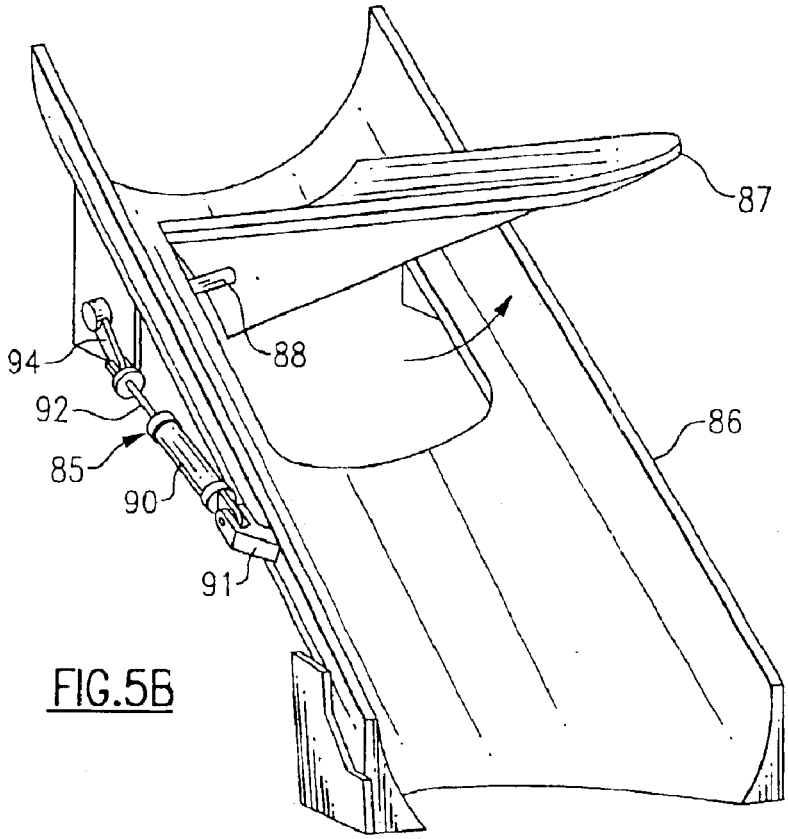
FIG. 5*b* is a view similar to FIG. 5*a* illustrating the lifting mechanism in an extended position.

A further embodiment of the invention is illustrated in FIGS. 5*a* and 5*b*. In this embodiment, a lifting mechanism, generally referenced 85, is mounted in the wall of the spout section 86 of a chute and spout assembly. The lifting mechanism includes a door 87 that is mounted in the wall of the spout. The door is shown in a closed position in FIG. 5*a* and has a contour that complements the interior shape of the spout so that it will not impede the flow of logs through the spout when closed. The door is secured to a shaft 88 that is mounted for rotation in suitable bearing blocks secured to the outside of the spout. One end of a double acting pneumatic or hydraulic cylinder 90 is pinned to a bracket 91 that is also secured to the outer structure of the spout so that the cylinder can swing freely in the bracket. A piston rod 92 passes out of the other end of the cylinder and is connected to the shaft by a crank arm 94. The cylinder is arranged to move the door from the closed position shown in FIG. 5*a* into a fully open position as illustrated in FIG. 5*b*. The door is thus arranged to swing upwardly into the flow path described by the spout as the door moves from a closed to an open position to engage any logs that might become jammed in this section of the flow path and thus clear the jam. The door substantially closes the flow path and thus prevents material in the flow from passing beyond the door where it could cause a further jam.

While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed is:

1. Apparatus for processing logs to manufacture wood chips that includes:

a circular disc containing a series of blades;

a chipping station through which said series of blades are passed seriatim;

a conveyor;

a chute and spout assembly for feeding logs from the conveyor into the chipping station along a given flow path;

a lifting mechanism that is mounted for rotation upon a shaft, said shaft being located outside said spout and chute assembly, said lifting mechanism including at least one lifting member and at least one drive unit;

for turning said shaft so that the at least one lifting member is rotated between a retracted position wherein the at least one lifting member is outside of said flow path and an extended position wherein the at least one lifting member is rotated into engagement with logs located within said spout and chute assembly to move said logs generally contra to the direction of flow, said at least one lifting member having a width that substantially extends across the flow path when rotated into the extended position by said at least one drive unit.

2. The apparatus of claim 1, wherein said at least one lifting member includes a door that closes the flow path when in the extended position to prevent material in the flow path from passing beyond said door.

3. The apparatus of claim 1, wherein said at least one lifting member includes at least one arcuate shaped plate, said at least one plate being secured to said shaft for rotation therewith.

4. The apparatus of claim 3 wherein said at least one plate is perpendicularly aligned with the axis of rotation of said shaft.

5. The apparatus of claim 3 wherein said at least one plate is located at the entrance to a spout portion of said chute and spout assembly.

6. The apparatus of claim 5 wherein said at least one plate is recessed in a wall of said chute and spout assembly when said lifting member is in a retracted position.

7. The apparatus of claim 6 wherein said at least one plate complements the inside surface of the chute and spout assembly when the at least one plate is in a retracted position.

8. The apparatus of claim 3 wherein said at least one drive unit includes a double acting pneumatic or hydraulic cylinder pinned at one end in a stationary bracket and containing a movable piston rod extending from said other end of the cylinder and a rocker arm for connecting the extended end of the piston rod to said shaft.

9. The apparatus of claim 1 wherein a spout section of said chute and spout assembly is enclosed by a removable cover and further includes a pneumatic or hydraulic jack for moving said cover radially away from chute portion of said chute and spout assembly.

10. The apparatus of claim 9 that further includes a linkage mechanism for controlling the motion of said cover so that said cover moves both axially and radially with regard to said flow path as it separates from said spout section.

11. The apparatus of claim 1 that further includes a lever arm mounted for rotation upon an axle, said lever arm being located at the entrance to the chute and spout assembly, and actuating means for rotating said lever arm so that the lever arm is moved between a retracted position wherein said lever arm is outside of said entrance region and an extended position wherein said lever arm can engage logs located within said entrance to the chute and spout assembly.

12. The apparatus of claim 11 wherein said actuating means includes a double-acting pneumatic or hydraulic cylinder.

13. Apparatus for processing logs to produce wood chips:

a circular disc having a plurality of blades;

a chipping station through which said plurality of blades are passed;

a chute and spout assembly;

means for feeding logs through an entrance to said chute and spout assembly so that said logs are conveyed along a given flow path into said chipping station;

at least one plate mounted for rotation adjacent to the chute and spout assembly upon a shaft, and a first drive unit for rotating said plates between a retracted position outside of said flow path and an extended position inside said flow path wherein said at least one plate can engage and move logs that might be jammed within said flow path;

a positionable cover for enclosing the spout and a second drive unit for positioning said cover between a closed position over a spout section of said chute and spout assembly to an open position wherein said cover is moved radially and axially away from said spout section; and a lever arm mounted upon an axle adjacent to an entrance region to the chute and spout assembly, said lever arm being connected to a third drive unit for rotating the lever arm between a retracted position outside said flow path and an extended position inside said flow path wherein said lever can engage logs located within said entrance region and move logs that might be jammed in the flow path.

14. The apparatus of claim 13 wherein said first, second and third drive units are hydraulically or pneumatically actuated.

15. The apparatus of claim 14 that further includes a pumping unit for providing fluid to each of said drive units.

16. The apparatus of claim 15 that further includes a control mechanism for controlling the pumping system wherein said drive units can be actuated either simultaneously, in selected pairs or individually.

17. The apparatus of claim 13 including at least two plates and wherein the spacing between the plates is such to prevent logs in the flow from passing between the plates.

18. The apparatus of claim 1, wherein said lifting mechanism of spaced apart arcuate plates.

19. The apparatus of claim 18, wherein each of said plurality of arcuate plates has a different radius.

* * * * *